US007549477B2

(12) United States Patent
Khoshnevis

(10) Patent No.: US 7,549,477 B2
(45) Date of Patent: Jun. 23, 2009

(54) SYSTEM AND METHOD FOR UNLOADING WATER FROM GAS WELLS

(75) Inventor: Behrokh Khoshnevis, Marina Del Rey, CA (US)

(73) Assignee: University of Southern California, Los Angeles, CA (US)

( * ) Notice: Subject to any disclaimer, the term of this patent is extended or adjusted under 35 U.S.C. 154(b) by 196 days.

(21) Appl. No.: 11/489,764

(22) Filed: Jul. 20, 2006

(65) Prior Publication Data

US 2007/0169941 A1 Jul. 26, 2007

Related U.S. Application Data

(60) Provisional application No. 60/700,988, filed on Jul. 20, 2005, provisional application No. 60/729,675, filed on Oct. 24, 2005.

(51) Int. Cl.
*E21B 21/14* (2006.01)

(52) U.S. Cl. ..... 166/372; 166/311

(58) Field of Classification Search ..... 166/311, 166/312, 370, 372
See application file for complete search history.

(56) References Cited

U.S. PATENT DOCUMENTS 4,527,633 A * 7/1985 McLaughlin et al. ..... 166/370
4,832,121 A 5/1989 Anderson
5,211,242 A * 5/1993 Coleman et al. ..... 166/372
5,501,279 A * 3/1996 Garg et al. ..... 166/372
5,610,331 A 3/1997 Georgi
6,354,377 B1 * 3/2002 Averhoff ..... 166/372
6,629,566 B2 * 10/2003 Liknes ..... 166/372
6,766,854 B2 7/2004 Ciglenec et al.
6,810,961 B2 11/2004 Marvel et al.
6,817,257 B2 11/2004 Kluth et al.
6,896,074 B2 5/2005 Cook et al.
6,920,395 B2 7/2005 Brown
7,311,150 B2 * 12/2007 Zupanick ..... 166/311

OTHER PUBLICATIONS

E. Beauregard, Southwest Petroleum Short Course Assn., and Paul L. Ferguson; "Introduction to Plunger Lift: Applications, Advantages and Limitations"; SPE 10882; SPE Rocky Mountain Regional Meeting, Billings, Montana, May 19-21, 1982.

J.B. Maggard, R.A. Wattenbarger, and S.L. Scott; "Modeling Plunger Lift for Water Removal from Tight Gas Wells"; SPE 59747; 2000 SPE/CERI Gas Technology Symposium, Calgary, Alberta, Canada, Apr. 3-5, 2000.

(Continued)

*Primary Examiner*—Jennifer H Gay
*Assistant Examiner*—Daniel P Stephenson
(74) *Attorney, Agent, or Firm*—Crowell & Moring LLP

(57) ABSTRACT

A system, apparatus and method are useful for lifting water in a gas-producing wellbore through the application of a differential between pressure of the gas in the wellbore's gas-production conduit and pressure of the wellbore annulus. The apparatus comprises a module disposed in the gas-producing wellbore for collecting by condensation water that has been lifted as water vapor with produced gas in a gas-production conduit disposed in the wellbore, and one or more lift modules for applying the pressure differential to lift the collected water within the wellbore.

23 Claims, 3 Drawing Sheets

OTHER PUBLICATIONS

Satya A. Putra, Pertamina, Indonesia, and Richard L. Christiansen; Design of Tubing Collar Inserts for Producing Gas Wells Below Their Critical Velocity; 2001 SPE Annual Technical Conference and Exhibition, New Orleans, Louisiana, Sep. 30-Oct. 3, 2001.

James F. Lea and Henry V. Nickens; "Solving Gas-Well Liquid-Loading Problems"; SPE 72092; Distinguished Author Series, Apr. 2004.

Fitrah Arachman, Kalwant Singh, James K. Forrest, Monas O. Purba; "Liquid Unloading in a Big Bore Completion: A Comparison Among Gas Lift, Intermittent Production, and Installation of Velocity String", SPE 88523; SPE Asia Pacific Oil and Gas Conference and Exhibition, Perth, Australia, Oct. 18-20, 2004.

W. Jelinek and L.L. Schramm; Improved Production From Mature Gas Wells by Introducing Surfactants Into Wells; IPTC 11028; International Petroleum Technology Conference, Doha, Qatar, Nov. 21-23, 2005.

Boyun Guo, Ali Ghalambor, and Chengcai Xu; "A Systematic Approach to Predicting Liquid Loading in Gas Wells"; SPE 94081; 2005 SPE Production Operations Symposium, Oklahoma City, OK, Apr. 17-19, 2005.

R. Rastegar Moghadam, B. Khoshnevis, and I. Ershaghi; "Dynamic Modeling of Partial Liquid Lift for Stripper Gas Wells"; SPE 100649; 2006 SPE Western Regional/AAPG Pacific Section/GSA Cordilleran Section Joint Meeting, Anchorage, Alaska; May 8-10, 2006.

* cited by examiner

SYSTEM AND METHOD FOR UNLOADING WATER FROM GAS WELLS

CROSS-REFERENCE TO RELATED APPLICATIONS

This application is related to U.S. Provisional Patent Application Ser. No. 60/700,988, filed on Jul. 20, 2005, and U.S. Provisional Patent Application Ser. No. 60/729,675, filed on Oct. 24, 2005, both entitled "Automatic Concurrent Water Collection (CWC) System for Unloading Gas Wells" the contents of which are both incorporated herein in their entirety by reference.

BACKGROUND OF THE INVENTION

1. Field of the Invention

The present invention relates to the unloading of water from gas wells, and more particularly to such water unloading that is achieved with little or no energy addition (such as pumping) requirements.

2. Background of the Related Art

Water is present in most wellbores that produce gas from a subsurface formation; such wellbores are also commonly known as gas wells. At the early stages of production the gas pressure in the gas-production tubing or conduit that is disposed in the wellbore is sufficiently large to lift the water that enters the gas-production conduit. At the top of the wellbore, commonly defined by a wellhead, gas and water vapor and mist exit the gas-production conduit where the water content is easily separated from gas. As the production of the wellbore continues over time the gas pressure drops to the point where the water therein can no longer be lifted by the produced gas flow. This results in the accumulation of water in the bottom of wellbore, or more particularly at the bottom of the gas-production conduit, sometimes rising to a height of several thousand feet from the bottom. In such situations wellbore production stops and the only remedy is water extraction (unloading). This is conventionally achieved by means of pumping the water out of the wellbore, which is often prohibitively expensive.

In the last several decades several other methods of water unloading have been devised to avoid water pumping. The most commonly-used methods are:

a) Reducing the diameter of the gas-production conduit in the wellbore to increase the gas flow speed and hence lift water mist all the way to the top of the wellbore. This method naturally reduces the gas-production rate and fails as soon as the gas pressure drops again below a critical limit.

b) Using surfactants such as detergents (e.g., soap) to reduce the water density by creation of foam, which is easier to lift by gas flow. These methods use consumable material and hence can be operationally expensive.

c) Using plunger lift, which is based on closing the top of the wellbore to let the gas pressure build up to a level which would make water lifting possible, followed by the sudden opening of the wellbore to allow the departure of the resulting high pressure gas and water mix. A solid cylinder is needed in this case, in order to push the water column up. This cylinder, called a "plunger" moves up and down the wellbore with every opening and closing of the wellbore, respectively. Because this method works intermittently it requires frequent shut-downs of the wellbore, which results in reduced overall production.

A need therefore exists for a water unloading solution that is free of the above-mentioned limitations, as well as other limitations and problems existing in the present solutions.

SUMMARY OF THE INVENTION

In one aspect, the present invention provides an apparatus for lifting water in a gas-producing wellbore, comprising a module disposed in the gas-producing wellbore for collecting by condensation water that has been lifted as water vapor or mist with produced gas in a gas-production conduit disposed in the wellbore, and one or more lift modules for applying a differential between the pressure of the gas in the gas-production conduit and the pressure of the wellbore to lift the collected water within the wellbore.

In particular embodiments of the inventive method, the water collection module is disposed about the gas-production conduit within the wellbore. More particularly, the wellbore may be lined with a casing string that defines the pressure of the wellbore and the water collection module may be disposed between the gas-production conduit and the casing within the wellbore.

In particular embodiments, wherein the water collection module is disposed beneath an upper segment of the wellbore. The upper segment of the wellbore may be, for example, approximately 3000 feet long.

In particular embodiments, the water collection module comprises a collection chamber disposed about the gas-production conduit for collecting water, and a collector funnel disposed in the gas-production conduit for collecting condensed water from the produced gas and directing the condensed water to the collection chamber. A transport conduit having a first end thereof may be disposed in the collection chamber. The collection chamber may be equipped with a first float-actuated valve assembly operable upon the water in the collection chamber reaching a sufficient level for opening the first end of the transport conduit so as to establish fluid communication between the transport conduit and the collection chamber. The transport conduit may be equipped with a one-way valve to prevent water in the transport conduit from returning to the collection chamber.

In such embodiments, a first differential-pressure lift module comprises an accumulation chamber disposed about the gas-production conduit for receiving water from the transport conduit, and a second float-actuated valve assembly. The second valve assembly is operable upon the water in the accumulation chamber reaching a sufficient level for opening an orifice in the gas-production conduit so as to pressurize the accumulation chamber, and for closing an orifice in the accumulation chamber so as to isolate the accumulation chamber from the wellbore. In the manner, the accumulation chamber is exposed to wellbore pressure until the second valve assembly is actuated upon which the accumulation chamber is exposed to pressure of the produced gas.

Such embodiments may further comprise one or more additional differential-pressure lift modules similar to the first lift module, with each lift module being interconnected by a further transport conduit fluidly connecting the accumulation chambers of the respective lift modules.

In particular embodiments, the inventive apparatus further comprises a pump disposed at a surface location adjacent the wellbore for enhancing the differential between pressure of the gas in the gas-production conduit and pressure of the wellbore to assist the one or more lift modules in lifting the collected water within the wellbore. Accordingly, in particular embodiments mentioned herein, the pump may be a suction pump disposed at a surface location adjacent the wellbore for selectively reducing the pressure of the wellbore to assist the one or more lift modules in lifting the collected water within the wellbore.

Similarly, a flow control valve assembly may be disposed at a surface location adjacent the wellbore for selectively restricting the flow of produced gas from the gas-production conduit to increase the pressure therein and to assist the one or more lift modules in lifting the collected water within the wellbore.

In another aspect, the present invention provides a method for lifting water in a gas-producing wellbore, comprising the steps of collecting by condensation water that has been lifted as water vapor or mist with produced gas in a gas-production conduit disposed in the wellbore, and applying a differential between the pressure of the gas in the gas-production conduit and the pressure of the wellbore to lift the collected water within the wellbore.

In particular embodiments of the invention method, the water-collecting step comprises disposing a collector funnel in the gas-production conduit for collecting condensed water from the produced gas and directing the condensed water to a collection chamber, whereby the collected water is pressurized by the produced gas. The method may further comprise the steps of disposing a first end of a transport conduit in the collection chamber, and exposing a second end of the transport conduit to wellbore pressure. In this manner, water in the collection chamber is urged by differential pressure to flow from the collection chamber to the transport conduit.

In such embodiments, the inventive method may further comprise the step of accumulating the water flowing in the transport conduit in an accumulation chamber. The second end of the transport conduit may be exposed to wellbore pressure via an orifice in the accumulation chamber. Accordingly, the accumulation chamber may be charged for further lifting the collected water in the wellbore, by the further steps of closing the orifice in the accumulation chamber, and pressurizing the accumulation chamber with the produced gas, with the closing and pressurizing steps both occurring upon the water in the accumulation chamber reaching a sufficient level.

In a further aspect, the present invention provides a system for lifting water in a gas-producing wellbore, comprising a module disposed in the gas-producing wellbore for collecting by condensation water that has been lifted as water vapor or mist with produced gas in a gas-production conduit disposed in the wellbore. A plurality of lift modules are disposed in the gas-producing wellbore above the water-collection module for applying a differential between the pressure of the gas in the gas-production conduit and the pressure of the wellbore to lift the collected water within the wellbore.

BRIEF DESCRIPTION OF THE DRAWINGS

So that above recited features and advantages of the present invention can be understood in detail, a more particular description of the invention, briefly summarized above, is provided by reference to the embodiments thereof that are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION OF THE INVENTION

Figure 1:
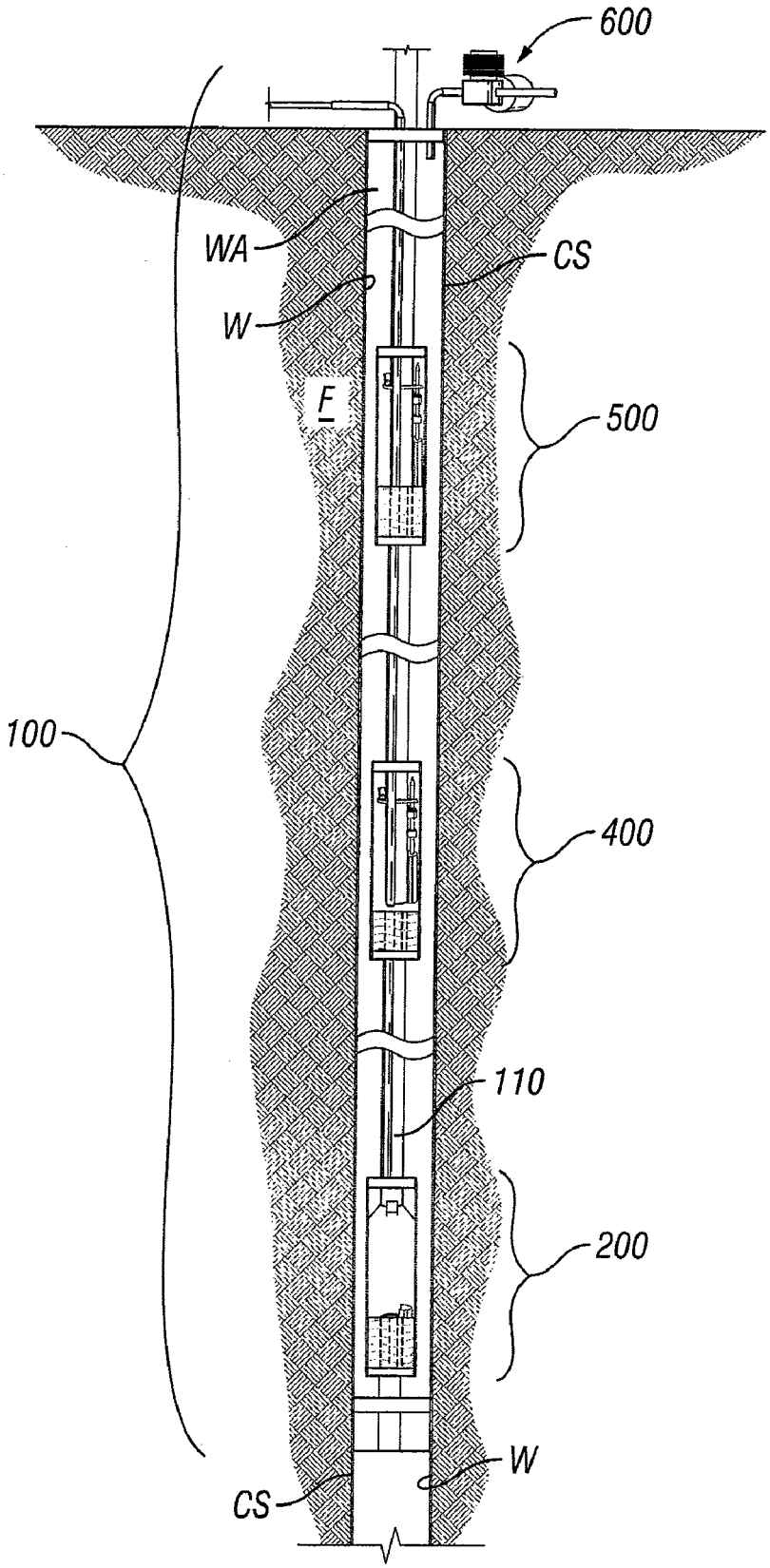
FIG. 1 is a sectional representation of a system for lifting water in a gas-producing wellbore according to the present invention.

FIG. 1 illustrates one embodiment of the present invention in the form of a system 100 for lifting water in a gas-producing wellbore W that is lined by a casing string CS, and that penetrates a subsurface gas formation F. The system 100 comprises a module 200 disposed in the gas-producing wellbore W for collecting by condensation water that has been lifted as water mist or vapor with produced gas in a gas-production conduit 110 disposed in the casing string CS of the wellbore W. A plurality of lift modules 400, 500 (only two being shown for clarity in FIG. 1) are employed for applying a differential between the pressure of the gas in the gas-production tubing or conduit 110 and the pressure of the wellbore W (i.e., the pressure within the casing string CS) to lift the collected water within the wellbore W.

The inventive system (as well as the included apparatus and the method that is implemented thereby) benefits from the fact that a great portion of the water which exists at the bottom of the wellbore, particularly at the bottom of the gas-production conduit 110, is actually the result of the condensation of water vapor and consolidation of water mist in form of larger droplets in the upper segment of the conduit 110 (e.g., the upper 3000-foot segment), where the temperature is much reduced, and a downward flowing of the condensed water. Other methods allow for return of the previously-lifted water to lower wellbore elevations, thereby losing all the valuable potential energy that has been put into the water by the gas-lifting operation that first delivered it to the higher wellbore elevations. Consequently, most of the energy used by conventional means for water lifting is effectively compensating for the loss of the potential energy already experienced by the portion of the water which flowed to the bottom of the wellbore as a result of condensation and consolidation. The present invention mitigates the need for such compensation by conserving potential energy in the lifted water vapor/mist, and by employing very few moving parts that do not use power, that operate automatically, and that are expected to require infrequent maintenance.

Figure 2:
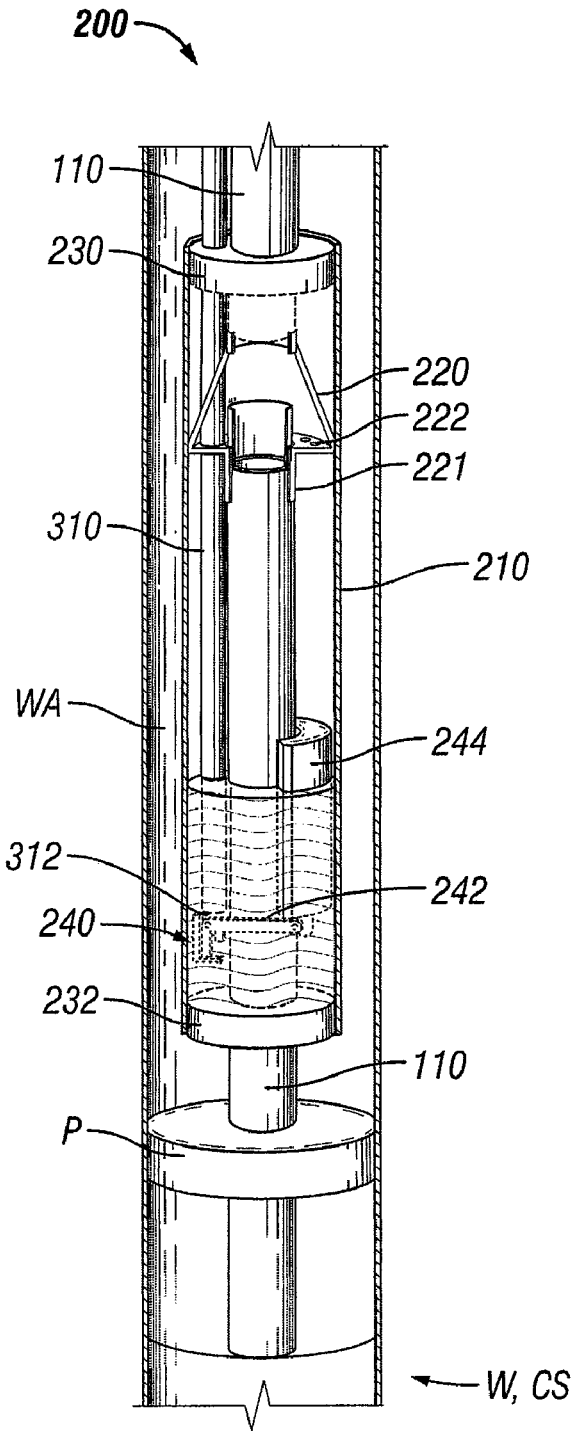
FIGS. 2 is a detailed sectional representation of a water collection module according to the present invention.

FIG. 2 is a detailed sectional representation of the water collection module 200 shown as a generally cylindrical apparatus disposed between the gas-production conduit 110 and the casing CS within the wellbore W. The water collection module 200 may be disposed beneath an upper segment of the wellbore, such as, for example, an upper segment that is approximately 3000 feet long, in order to capture a substantial portion of the water vapor/mist that may evaporate and flow downwardly through the wellbore. A packer P may be set in the casing CS beneath the module 200, in a manner that is well known, to isolate the upper wellbore annulus WA from lower segments of the wellbore.

The water collection module 200 comprises a cylindrical collection housing or chamber 210, preferably of a suitable stainless steel construction, disposed about the gas-production conduit 110 for collecting water. The collection chamber 210 is closed by respective upper and lower caps 230, 232. A collector funnel 220 is disposed in the gas-production conduit 110, defining an open segment in the conduit for collecting condensed water from the produced gas at relatively high elevations, and directing the condensed water to the collection chamber 210. It will be appreciated by those having ordinary skill in the art that because of the upward flow of gas in the gas-production conduit 110, the returned water is directed to the funnel 220 rather than into the upwardly-facing conduit portion at the open segment (attached to the lower portion 221 of the funnel 220). Because the collection chamber 210 has open channels into the gas-production conduit (through holes 222 in the funnel 220), the internal pressure of the chamber 210 is the same as the gas pressure inside the gas-production conduit 110 at the elevation of the collection module 200.

A first transport tubing or conduit 310 extends downwardly into the collection chamber 210 through a sealed orifice in the upper cap 230, such that a first, lower end 312 thereof is disposed in the lower region of the collection chamber 210. The second, upper end of the transport conduit 310 extends above the collection module 200, for a purpose that will be described below.

The collection chamber 210 is further equipped with a first float-actuated valve assembly 240 operable upon the water in the collection chamber reaching a sufficient level. The valve assembly 240 is equipped with a pivotally-mounted valve lever 242 and a float body 244 that is constrained to reciprocate (substantially) vertically within the chamber 210 adjacent the gas-production conduit 110. As the water level rises in the collection chamber 210, it lifts the float body 244 which in turn pivots the valve lever 242 to open the valve assembly 240, thereby opening the first, lower end 312 of the transport conduit 310 so as to establish fluid communication between the transport conduit 310 and the collection chamber 210. This results in the transport of water from the collection chamber 210 upwardly through the transport conduit 310 and out of the chamber 210. This water transport process is automated by employing differential pressure that exists between the wellbore annulus WA and the gas-production conduit 110, and more particularly by exposing the upper portion of the transport conduit to the lower pressure of the wellbore annulus (as described below) and exposing the collection chamber 210 to the higher pressure of the gas-production conduit 110 (via funnel holes 222). In this manner, if the gas-production conduit 110 at the collection module elevation has a pressure of 200 psia and the upper opening of the transport conduit 310 is exposed to atmospheric pressure (i.e., wellbore annulus at atmospheric pressure), then the water can be lifted up 400 feet or more above the collection module 200. It will be further appreciated that the float-actuated valve assembly 240 allows only water and not gas to flow into the transport conduit 310, because the valve is open only when there is sufficient water accumulated in the collection chamber 210 to lift the float body 244. Additionally, the transport conduit 310 is equipped with a one-way valve at or near its first, lower end 312 that prevents water from returning to the collection chamber 210.

Figure 3:
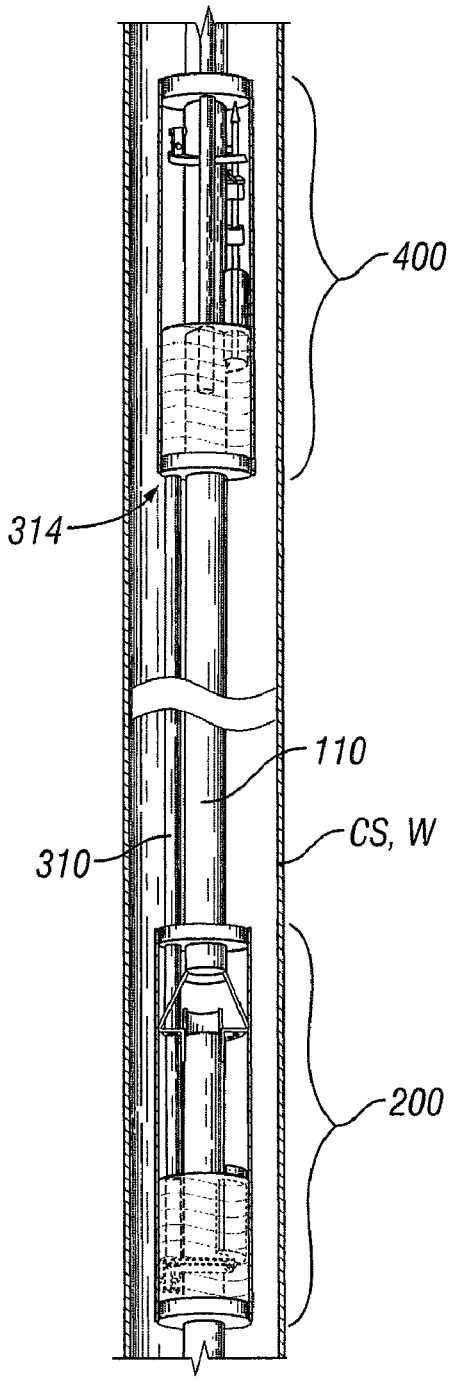
FIG. 3 is a sectional representation of the water collection module of FIG. 2 connected via a transport conduit to a first lift module according to the present invention.
Figure 4A:
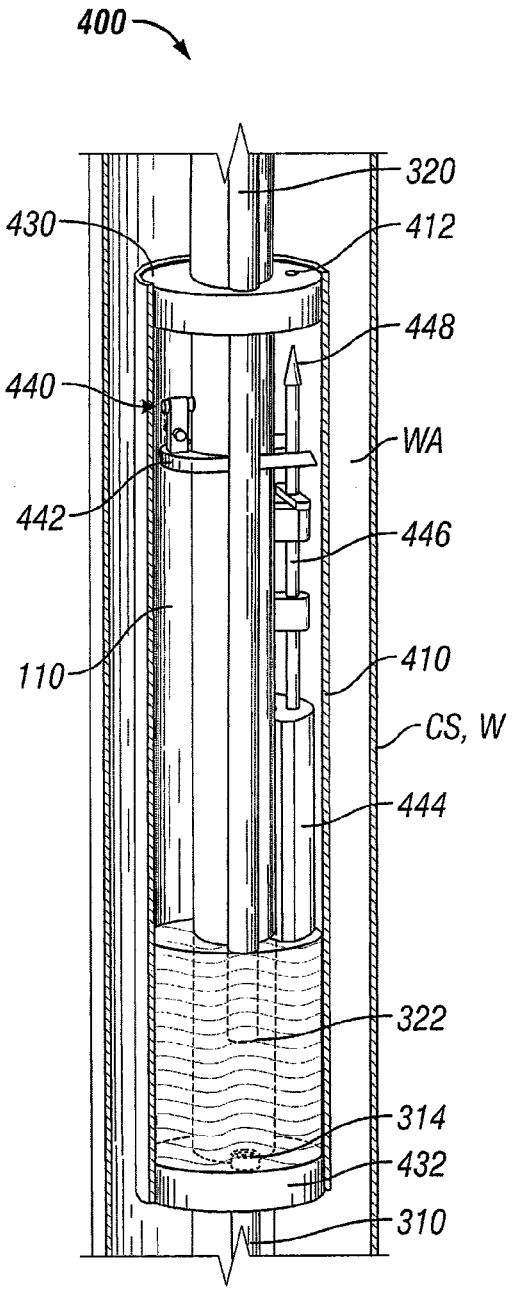
FIGS. 4A-4B are detailed sectional representations of the lift module of FIG. 3, showing a float-actuated valve assembly of the lift module in respective normal and actuated positions.

FIG. 3 is a sectional representation of the water collection module 200 connected via the transport conduit 310 to a first lift module 400, in particular at the second, upper end 314 of the transport conduit 310. FIG. 4A is a further sectional representation showing the first lift module 400 in greater detail. The first lift module 400 employs differential-pressure to achieve, in cooperation with the collection module 200, a lifting of the water from the collection chamber 210. The first lift module 400 comprises an accumulation chamber 410, preferably of a suitable stainless steel construction, disposed about the gas-production conduit 110 for receiving water from the transport conduit 310. The accumulation chamber 410 is closed by respective upper and lower caps 430, 432.

Figure 4B:
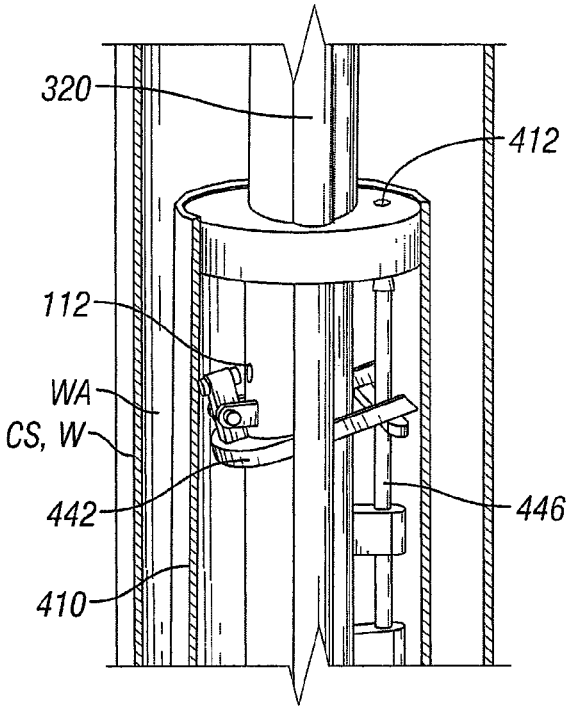

The accumulation chamber 410 is further equipped with a second float-actuated valve assembly 440, 446, 448 that is operable upon the water in the accumulation chamber 410 reaching a sufficient level for opening an orifice 112 (shown in FIG. 4B) in the gas-production conduit 110 so as to pressurize the accumulation chamber 410. The second valve assembly 440 is further operable upon such actuation by the water level in the accumulation chamber 410 to close an orifice 412 in therein so as to isolate the accumulation chamber 412 from the wellbore annulus WA. In the manner, the accumulation chamber 410 is exposed to wellbore pressure until the second valve assembly 440 is actuated, upon which the accumulation chamber 410 is exposed to pressure of the produced gas at the elevation of the lift module 400.

A second transport tubing or conduit 320 extends downwardly into the accumulation chamber 410 through a sealed orifice in the upper cap 430, such that a first, lower end 322 thereof is disposed in the lower region of the accumulation chamber 410. This second transport conduit 320, and other similar transport conduits, facilitate the use of additional differential-pressure lift modules (like lift module 500 of FIG. 1) similar to the first lift module 400, with each lift module being interconnected by a further transport conduit fluidly connecting the accumulation chambers of the respective lift modules. All such transport conduits are equipped with one-way valves (like conduit 310 is) that prevent reverse (i.e., downward) water flow therethrough.

Thus, in operation, water lifted (or pushed) out of the water collection module 200 (which may also be referred to as a "WC" module) enters the chamber 410 of the lift module 400 (which may also be referred to as a water push-up module/station or "WSP" module/station), which is an intermediate lift module (see higher lift module 500 in FIG. 1) positioned above the collection module 200. The elevation of the lift module 400 within the wellbore W, relative to the collection module 200, is limited by the maximum lift potential that is achievable by the available pressure differential between the wellbore annulus WA and the gas-production tubing at the level of the collection module chamber 210. As explained above, if the maximum lift potential under representative conditions is approximately 400 feet, the accumulation chamber 410 should be positioned along the gas-production conduit 110 at an elevation of no more than approximately 390 feet above the collection module 210. The lift module 400 is operable to receive, accumulate and lift (i.e., push) water upwardly according to the following stages:

1) allow the pressure at the second, upper opening 314 of the first transport conduit 310 that enters its accumulation chamber 410 from below to drop to the pressure of the wellbore annulus WA by setting the vertical position of the float body 444, valve stem 446, and conical valve closure element 448—under low water levels in the chamber 410—to open the orifice 412 that fluidly connects the chamber 410 to the wellbore annulus WA (this is the position of FIG. 4A);

2) accumulate the water received in the chamber 410 until the float body 444 rises to the point where it urges the valve stem 446 and conical valve closure element 448 to close the orifice 412 and almost simultaneously open the orifice 112 (via pivotal valve lever 442 attached to stem 446) which increases the inner pressure of the accumulation chamber 410 to that of the gas-production conduit 110 at the elevation of the first lift module 400 (e.g., 180 psia at 3000-390=2620 feet);

3) lift (i.e., push) the water in its accumulation chamber 410 upwardly into a second transport conduit 320 which directs the water into another lift module 500 located at a higher elevation slightly below the maximum potential to which the water can be lifted by the pressure of the produced gas in the conduit 110 at the elevation where the first lift module 400 is positioned; and 4) close the orifice 412 in the chamber 410 and the orifice 112 in the gas-production conduit 110 as the water level in the chamber 410 is reduced, and the float body, valve stem 446, and conical valve closure element 448 all are vertically lowered accordingly.

It will therefore be appreciated that several differential-pressure lift modules may be employed to lift the water in a stage-wise fashion from the collection module 200 all the way to the top of the wellbore W for ultimate disposal via a surface conduit 610 extending from an upper wellbore packer 620, entirely by the gas-driven pressure differential and without the use of external energy. Distances between respective, staged lift modules will become progressively smaller at higher elevations, because the gas pressure inside the gas-production conduit 110 decreases as the elevation increases.

Figure 5:
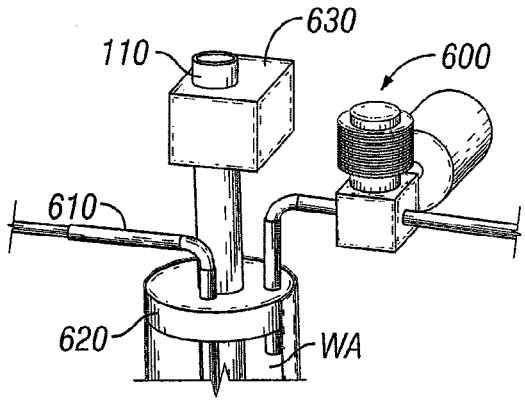
FIG. 5 shows a detailed representation of the upper region of a wellbore equipped with a suction pump to enhance water-lift potential according to one aspect of the present invention.

When gas-production pressure drops over time, the collection module 200 and various lift modules 400, 500, etc. may not have sufficient differential pressure available to elevate the water sufficiently to reach the next lift module. For this reason, the inventive system 100 may further comprise a suction pump 600 (shown in FIGS. 1 and 5) or other device disposed at a surface location adjacent the wellbore W for selectively reducing the pressure of the wellbore annulus WA to assist the one or more lift modules in lifting the collected water within the wellbore. Such a pump 600 would likely be relatively small and inexpensive, and could, for example, be powered with a nearby solar panel (not shown). Additionally, to minimize energy use and maximize pump life the pump 600 could be activated automatically using a sensor that detects the outflow rate of water, and automatically operates the pump to increase the water unloading rate when water flow rate dropped below a threshold value.

A flow control valve assembly 630 could also be employed at the surface, either alone or in combination with the suction pump 600, for selectively restricting the flow of produced gas from the gas-production conduit 110 to increase the pressure therein and to assist the one or more lift modules in lifting the collected water within the wellbore. One disadvantage of such a valve assembly 630, however, is that is reduces the produced gas flow.

The present invention, as described herein according to particular embodiments and aspects thereof, is useful for unloading water concurrently with gas production from a gas wellbore, and therefore—unlike conventional plunger lift systems—does not require periodic wellbore shut downs. Also unlike the plunger lift systems, in which high impact and high friction frequently destroy the plunger and other components that are contacted by the plunger (packer, conduit, etc.), the moving parts in a system according to the present invention exhibit small and low-impact movements and are expected to operate without incident for several years with minimal maintenance requirement.

It will be understood from the foregoing description that various modifications and changes may be made in the preferred and alternative embodiments of the present invention without departing from its true spirit. For example, it is possible to apply the advantages of the present invention in conjunction with known plunger lift systems, if so desired. This may be useful in certain situations where down-hole water accumulation is significant. It is expected, however, that the inventive system (including its employed apparatus and implemented methods) will be useful for reducing the water level in most if not all gas wellbores, and therefore aid in reaching a steady state condition at which water is unloaded at a consistent rate.

This description is intended for purposes of illustration only and should not be construed in a limiting sense. The scope of this invention should be determined only by the language of the claims that follow. The term "comprising" within the claims is intended to mean "including at least" such that the recited listing of elements in a claim are an open set or group. Similarly, the terms "containing," having," and "including" are all intended to mean an open set or group of elements. "A," "an" and other singular terms are intended to include the plural forms thereof unless specifically excluded.

What is claimed is:

1. An apparatus for lifting water in a gas-producing wellbore, comprising:

a module disposed in the gas-producing wellbore for collecting by condensation water being lifted as water vapor or mist with produced gas in a gas-production conduit disposed in the wellbore; and one or more lift modules for applying a differential between the pressure of the gas in the gas-production conduit and the pressure of the wellbore to lift the collected water within the wellbore;

wherein the water collection module is disposed about the gas-production conduit within the wellbore and comprises:

a collection chamber disposed about the gas-production conduit for collecting water; and a collector funnel disposed in the gas-production conduit for collecting condensed water from the produced gas and directing the condensed water to the collection chamber.

2. The apparatus of claim 1, wherein the wellbore is lined with a casing string that defines the pressure of the wellbore and the water collection module is disposed between the gas-production conduit and the casing within the wellbore.

3. The apparatus of claim 1, wherein the water collection module is disposed beneath an upper segment of the wellbore.

4. The apparatus of claim 3, wherein the upper segment of the wellbore is approximately 3000 feet long.

5. The apparatus of claim 1, wherein the water collection module further comprises:

a transport conduit having a first end thereof disposed in the collection chamber; and wherein the collection chamber is equipped with a first float-actuated valve assembly operable upon the water in the collection chamber reaching a sufficient level for opening the first end of the transport conduit so as to establish fluid communication between the transport conduit and the collection chamber.

6. The apparatus of claim 5, wherein the transport conduit is equipped with a one-way valve to prevent water in the transport conduit from returning to the collection chamber.

7. The apparatus of claim 6, wherein a first differential-pressure lift module comprises:

an accumulation chamber disposed about the gas-production conduit for receiving water from the transport conduit; and a second float-actuated valve assembly operable upon the water in the accumulation chamber reaching a sufficient level for opening an orifice in the gas-production conduit so as to pressurize the accumulation chamber, and closing an orifice in the accumulation chamber so as to isolate the accumulation chamber from the wellbore;

whereby the accumulation chamber is exposed to wellbore pressure until the second valve assembly is actuated upon which the accumulation chamber is exposed to pressure of the produced gas.

8. The apparatus of claim 7, further comprising one or more additional differential-pressure lift modules similar to the first lift module, each lift module being interconnected by a further transport conduit fluidly connecting the accumulation chambers of the respective lift modules.

9. The apparatus of claim 8, further comprising a pump disposed at a surface location adjacent the wellbore for reducing the pressure of the wellbore to assist the one or more lift modules in lifting the collected water within the wellbore.

10. The apparatus of claim 1, further comprising a pump disposed at a surface location adjacent the wellbore for enhancing the differential between pressure of the gas in the gas-production conduit and pressure of the wellbore to assist the one or more lift modules in lifting the collected water within the wellbore.

11. A method for lifting water in a gas-producing wellbore, comprising the steps of:

collecting by condensation water being lifted as water vapor or mist with produced gas in a gas-production conduit disposed in the wellbore; and applying a differential between the pressure of the gas in the gas-production conduit and the pressure of the wellbore to lift the collected water within the wellbore;

wherein the water-collecting step comprises disposing a collector funnel in the gas-production conduit for collecting condensed water from the produced gas and directing the condensed water to a collection chamber, whereby the collected water is pressurized by the produced gas.

12. The method of claim 11, further comprising the steps of:

disposing a first end of a transport conduit in the collection chamber; and exposing a second end of the transport conduit to wellbore pressure;

whereby water in the collection chamber is urged by differential pressure to flow from the collection chamber to the transport conduit.

13. The method of claim 12, further comprising the step of accumulating the water flowing in the transport conduit in an accumulation chamber.

14. The method of claim 13, wherein:

the second end of the transport conduit is exposed to wellbore pressure via an orifice in the accumulation chamber; and further comprising the steps of closing the orifice in the accumulation chamber, and pressurizing the accumulation chamber with the produced gas, the closing and pressurizing steps occurring upon the water in the accumulation chamber reaching a sufficient level;

whereby the accumulation chamber is charged for further lifting the collected water in the wellbore.

15. A system for lifting water in a gas-producing wellbore, comprising:

a module disposed in the gas-producing wellbore for collecting by condensation water that has been lifted as water vapor or mist with produced gas in a gas-production conduit disposed in the wellbore; and a plurality of spaced apart lift modules disposed in the gas-producing wellbore above the water-collection module for applying a differential between the pressure of the gas in the gas-production conduit and the pressure of the wellbore to lift the collected water within the wellbore.

16. The system of claim 15, wherein the water collection module comprises:

a collection chamber disposed about the gas-production conduit for collecting water; and a collector funnel disposed in the gas-production conduit for collecting condensed water from the produced gas and directing the condensed water to the collection chamber.

17. The system of claim 16, wherein the water collection module further comprises:

a transport conduit having a first end thereof disposed in the collection chamber; and wherein the collection chamber is equipped with a first float-actuated valve assembly operable upon the water in the collection chamber reaching a sufficient level for opening the first end of the transport conduit so as to establish fluid communication between the transport conduit and the collection chamber.

18. The system of claim 17, wherein a first differential-pressure lift module is disposed above the water-collection chamber and comprises:

an accumulation chamber disposed about the gas-production conduit for receiving water from the transport conduit; and a second float-actuated valve assembly operable upon the water in the accumulation chamber reaching a sufficient level for opening an orifice in the gas-production conduit so as to pressurize the accumulation chamber, and closing an orifice in the accumulation chamber so as to isolate the accumulation chamber from the wellbore;

whereby the accumulation chamber is exposed to wellbore pressure until the second valve assembly is actuated upon which the accumulation chamber is exposed to pressure of the produced gas.

19. The system of claim 18, wherein each additional differential-pressure lift module is similar to the first lift module, and each of the lift modules are interconnected by further respective transport conduits fluidly connecting the accumulation chambers of the respective lift modules.

20. The system of claim 19, wherein each transport conduit is equipped with a one-way valve to prevent water in the transport conduit from returning to its source.

21. The system of claim 19, further comprising a pump disposed at a surface location adjacent the wellbore for selectively reducing the pressure of the wellbore to assist the one or more lift modules in lifting the collected water within the wellbore.

22. The system of claim 19, further comprising a flow control valve assembly disposed at a surface location adjacent the wellbore for selectively restricting the flow of produced gas from the gas-production conduit to increase the pressure therein and to assist the one or more lift modules in lifting the collected water within the wellbore.

23. The system of claim 15, further comprising a pump disposed at a surface location adjacent the wellbore for enhancing the differential between pressure of the gas in the gas-production conduit and pressure of the wellbore to assist the one or more lift modules in lifting the collected water within the wellbore.

* * * * *